US007618760B2

(12) United States Patent
Kikushima

(10) Patent No.: US 7,618,760 B2
(45) Date of Patent: Nov. 17, 2009

(54) TWO-COMPONENT DEVELOPER

(75) Inventor: Seiji Kikushima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 326 days.

(21) Appl. No.: 11/708,493

(22) Filed: Feb. 21, 2007

(65) Prior Publication Data

US 2007/0202426 A1 Aug. 30, 2007

(30) Foreign Application Priority Data

Feb. 27, 2006 (JP) ..... 2006-049583

(51) Int. Cl.
*G03G 9/08* (2006.01)

(52) U.S. Cl. ..... 430/108.7; 430/111.4

(58) Field of Classification Search ..... 430/108.7, 430/111.4
See application file for complete search history.

(56) References Cited

U.S. PATENT DOCUMENTS 5,994,019 A * 11/1999 Okado et al. ..... 430/122.4
2005/0233239 A1* 10/2005 Fujiwara et al. ..... 430/111.33

FOREIGN PATENT DOCUMENTS

| | | |
|---|---|---|
| JP | 02-067567 | 3/1990 |
| JP | 05-181304 | 7/1993 |
| JP | 2004-240158 | 8/2004 |
| JP | 2004-264602 | 9/2004 |

* cited by examiner

*Primary Examiner*—John L Goodrow
(74) *Attorney, Agent, or Firm*—Rabin & Berdo, PC

(57) ABSTRACT

A two-component developer suppresses burying of an external additive into toner particles and a change in charging performance of a toner with time, and secures stable development performance. The two-component developer includes a toner and a carrier and is adjusted so that a rate of change ΔA % in BET specific surface area A ($m^2/g$) of the toner ($=((A_{120}-A_1)/A_1)\times 100$) and a rate of change ΔC % in charge quantity C (μC/g) of the carrier ($=((C_{120}-C_1)/C_1)\times 100$) when a mixture of the toner and the carrier is stirred and mixed are both within 10 %. $A_1$ and $A_{120}$ indicate BET specific surface areas of the toner when the mixture of the toner and the carrier is stirred and mixed for 1 minute and 120 minutes, and $C_1$ and $C_{120}$ indicate charge quantities of the carrier when the mixture is stirred and mixed for 1 minute and 120 minutes.

5 Claims, No Drawings

TWO-COMPONENT DEVELOPER

BACKGROUND OF THE PRESENT INVENTION

The present invention relates to a two-component developer used for development of an electrostatic latent image.

DESCRIPTION OF RELATED ART

Generally, in a nonmagnetic toner (hereinafter, it may be simply referred to as "toner") of a two-component developer containing the nonmagnetic toner and a magnetic carrier, for the purpose of adjusting the fluidity and charging performance of the toner, inorganic microparticles such as silica microparticles and titanium oxide microparticles are added to the surfaces of toner particles. However, such inorganic microparticles are easily buried in the toner particles due to friction with the carrier in a development unit and stress from stirring a developer and conveying member, and as a result, the charging performance and fluidity of the toner are susceptible to change.

Therefore, it has been proposed that resin microparticles are added as well as the inorganic microparticles to the surfaces of the toner particles. In detail, there have been proposed:

- a two-component developer containing magnetic particles and toner particles, which contains colorant-containing resin particles, a fluidity improver (hydrophobized inorganic oxides, etc.), and spherical resin microparticles (polyvinylidene fluoride microparticles, etc.) having a particle diameter larger than that of the fluidity improver, and whose frictional charge quantity after the spherical resin microparticles and the magnetic particles are mixed is set in an appropriate range (Japanese Unexamined Patent Publication No. H02-67567);
- a toner with which silica microparticles and cross-linked organic microparticles having an average primary particle size larger than that of the silica microparticles are added to the surfaces of the toner particles (Japanese Unexamined Patent Publication No. H05-181304);
- a toner with which hydrophobic silica microparticles and two kinds of resin microparticles different in particle size are added (Japanese Unexamined Patent Publication No. 2004-264602); and
- a toner with which negative charging resin microparticles and positive charging inorganic microparticles are attached to the surfaces of the toner mother particles (Japanese Unexamined Patent Publication No. 2004-240158).

In a hybrid development method, that is, in a development method in which using a development unit including a development roller disposed to face a photosensitive drum (electrostatic latent image carrier) and a magnetic roller disposed to face this development roller, a two-component developer is held on the peripheral surface of the magnetic roller and then brought into contact with the peripheral surface of the development roller to form a layer consisting of only the toner in the two-component developer on the development roller, and the obtained toner layer is flown onto the photosensitive drum and an electrostatic latent image formed in advance on the photosensitive drum is developed as a toner image, adhesion of the toner to the two different toner carriers (carriers on the development roller and the magnetic roller) mustbe stabilized.

However, carriers on the development roller and the magnetic roller are different from each other in contact area with the toner, so that excessive adhesion easily occurs between the toner and the development roller, and adhesion deficiency easily occurs between the toner and the carriers.

Therefore, when a two-component developer is used for the hybrid development method, a change in the charge quantity of the toner with time according to burying of an external additive (inorganic microparticles, etc.) into toner particles must be more highly suppressed than a developer used for a one-component development method or a developer used for a conventional two-component development method.

In addition, in an image forming apparatus using an amorphous silicon photoreceptor as an electrostatic latent image carrier, the voltage resistance performance of the amorphous silicon photoreceptor is low, so that development at a low potential is necessary. However, in the case of the low-potential development, the development electrical field is small, so that it is difficult to secure a margin for lowering in development performance and reproduction of halftone. Therefore, as in the above-described case, when the amorphous silicon photoreceptor is used, it is necessary to more highly suppress the change in the charge quantity of the toner with time.

However, the developersdescribed in the Patent publications cannot sufficiently achieve an effect for preventing external additives from burying into toner particles when, for example, the developer is stirred in a development unit for a long period of time and the time of contact with the carriers last long. Therefore, when the developers described in the Patent publications are applied to image forming processing using the hybrid development method or image forming processing in an image forming processor using an amorphous silicon photoreceptor and the image forming processing is repeated, the charging performance and fluidity of the toner easily fluctuate and the charge quantity of the developer changes comparatively early to cause image density failure, image fogging, and toner scattering easily.

SUMMARY OF THE INVENTION

An object of the present invention is to solve the above-described problems and provide a two-component developer which suppresses burying of an external additive into toner particles and a change in charging performance of the toner with time according to the burying, and can secure stable development performance even when image forming processing is repeated.

Another object of the present invention is to provide a two-component developer preferable in image forming processing by a so-called hybrid development method and in image forming processing in an image forming apparatus using an amorphous silicon photoreceptor.

To achieve the above-described objects, a developer of the present invention includes a toner containing toner particles which contain a binder resin and a colorant, resin microparticles adhering to the surfaces of the toner particles, and silica microparticles adhering to the surfaces of the toner particles, and a carrier containing magnetic particles and resin coat layers coated on the surfaces of the magnetic particles, wherein a rate of change ΔA (%) in BET specific surface area A ($m^2/g$) of the toner expressed by the following expression (i) and a rate of change ΔC (%) in charge quantity C (μC/g) of the carrier of the carrier expressed by the following expression (ii) when a mixture of the toner and the carrier is stirred and mixed by a TURBULA shaker mixer are both within 10%.

$$\Delta A=((A_{120}-A_1)/A_1)\times 100 \quad \text{(i)}$$

$$\Delta C=((C_{120}-C_1)/C_1)\times 100 \quad \text{(ii)}$$

(In the above-described expressions (i) and (ii), $A_1$ indicates a BET specific surface area ($m^2/g$) of the toner when the mixture of the toner and the carrier is stirred and mixed for one minute by a TURBULA shaker mixer, $A_{120}$ indicates a BET specific surface area ($m^2/g$) of the toner when the mixture of the toner and the carrier is stirred and mixed for 120 minutes by a TURBULA shaker mixer, $C_1$ indicates a charge quantity (μC/g) of the carrier when the mixture of the toner and the carrier is stirred and mixed for one minute by a TURBULA shaker mixer, and $C_{120}$ indicates a charge quantity (μC/g) of the carrier when the mixture of the toner and the carrier is stirred and mixed for 120 minutes by a TURBULA shaker mixer.)

According to the two-component developer, even when the developer is repeatedly stirred in a development unit and the time of contact with the carrier is long, it is possible to suppress burying of the external additive into toner particles and lowering charge quantity of the toner.

Therefore, the two-component developer can be preferably used as a two-component developer used in an image forming apparatus using a so-called hybrid development method or in an image forming apparatus using an amorphous silicon photoreceptor.

DESCRIPTION OF PREFERRED EMBODIMENT

A two-component developer of the present invention includes a toner containing toner particles which contain a binder resin and a colorant, resin microparticles adhering to the surfaces of the toner particles, and silica microparticles adhering to the surfaces of the toner particles, and a carrier containing magnetic particles and resin coat layers coated on the surfaces of the magnetic particles.

In the two-component developer of the present invention, a rate of change ΔA (%) in BET specific surface area A ($m^2/g$) of the toner expressed by-the following expression (i) when a mixture of the toner and the carrier is stirred and mixed by a TURBULA shaker mixer is set within 10% (that is, not less than −10% and not more than +10%) and a rate of change ΔC (%) in charge quantity C (μC/g) of the carrier expressed by the following expression (ii) when a mixture of the toner and the carrier is stirred and mixed by a TURBULA shaker mixer is set within 10% (that is, not less than −10% and not more than +10%).

$$\Delta A=((A_{120}-A_1)/A_1)\times 100 \quad \text{(i)}$$

$$\Delta C=((C_{120}-C_1)/C_1)\times 100 \quad \text{(ii)}$$

In the above-described expression (i), $A_1$ indicates a BET specific surface area ($m^2/g$) of the toner when the mixture of the toner and the carrier is stirred and mixed for one minute by a TURBULA shaker mixer, and $A_{120}$ indicates a BET specific surface area ($m^2/g$) of the toner when the mixture of the toner and the carrier is stirred and mixed for 120 minutes by a TURBULA shaker mixer. In the above-described expression (ii), C, indicates a charge quantity (μC/g) of the carrier when the mixture of the toner and the carrier is stirred and mixed for one minute by a TURBULA shaker mixer, and $C_{120}$ indicates a charge quantity (μC/g) of the carrier when the mixture of the toner and the carrier is stirred and mixed for 120 minutes by a TURBULA shaker mixer.

When the mixture of the toner and the carrier is stirred and mixed for one minute by the TURBULA shaker mixer, the states of the toner and carrier in the mixture can be approximated to a state that the toner newly brought as a starter (unused) into the development unit of the image forming apparatus (real apparatus) and the carrier and toner which is already contained and stirred in the development unit are sufficiently stirred and mixed.

When the mixture of the toner and carrier is stirred and mixed for 120 minutes by the TURBULA shaker mixer, the states of the toner and carrier in the mixture can be approximated to a state that the toner and carrier are in contact for a long period of time in the development unit of the image forming apparatus (real apparatus), the external additive is buried in the surfaces of the toner particles, and the charge quantity of the toner is accordingly changed.

When the rate of change ΔA in BET specific surface area of the toner and the rate of change ΔC in charge quantity of the carrier satisfy the above-described expressions, even when the stirring is repeated in the development unit and the time of contact with the carrier is long, a failure such as lowering in charge quantity of the toner according to the burying of the external additive into the toner particles can be suppressed.

The BET specific surface area of the toner can be calculated by the following expression (iii) provided that the ratio (T/C) of the toner blending quantity T to the carrier blending quantity C in the two-component developer is a (%), the BET specific surface area of the developer is b ($m^2/g$), and the BET specific surface area of the carrier is c ($m^2/g$).

$$(100(b-c)/a)+b \quad \text{(iii)}$$

The BET specific surface area of the toner is preferably 1.5 to 4 $m^2/g$, and more preferably 2 to 3.5 $m^2/g$ in practical use.

The charge quantity of the carrier can be measured by, for example, a suction charge quantity measuring device (for example, a q/m meter of the type "MODEL210HS" made by Trek Japan KK).

The charge quantity of the carrier is preferably 1 to 3 μC/g in practical use regardless of the degree of stirring in the development unit.

The toner in the two-component developer of the present invention contains toner particles that contain a binder resin and a colorant, resin microparticles adhering to the surfaces of the toner particles, and silica microparticles adhering to the surfaces of the toner particles.

As the binder resin for forming the toner particles, for example, various toner binder resins can be used such as styrene resins (for example, polystyrene, etc.), an acryl or methacryl resin (hereinafter, acryl and methacryl may be collectively referred to as "(meth)acryl", for example, polymethyl methacrylate, etc.), styrene-acryl resins (for example, a copolymer of styrene and (meth) acrylate monomer), olefin resins (for example, polyethylene, polypropylene, etc.), polyester resins (for example, polyethylene terephthalate, polybutylene terephthalate, etc.), polyamide resins, epoxy resins, and resins of a mixture of these. Among these, a resin having thermoplasticity is preferable.

As the colorant forming the toner particles, an appropriate one can be selected from colorants known as toner colorants according to tint required as the toner. In detail, the colorant is, for example, carbon black, aniline blue, Calcoil blue, chrome yellow, ultramarine blue, Du Pont Oil Red, quinoline yellow, methylene Blue chloride, Phthalocyanine Blue, Malachite Green Oxalate, Lamp Black, Rose Bengal, carmine 6B, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Pigment Yellow 74, C.I. Solvent Yellow 162, C.I Pigment Yellow 180, C.I. Pigment Yellow 185, C.I. Pigment Blue 15:1, and C.I. Pigment Blue 15:3, etc.

The content of the colorant is, for example, with respect to 100 parts by weight of the binder resin for forming the toner particles, preferably 1 to 10 parts by weight, and more preferably 2 to 6 parts by weight although it is not especially limited.

The toner particles may contain, for example, a charge control agent, a charge control resin, etc., in addition to the binder resin and the colorant.

As the charge control agent, various charge control agents can be used which are used as a positive charge control agent for controlling the toner to have a positive charging property and controlling the toner to have a negative charging property.

Among these, as the a positive charge control agent, for example, quaternary ammonium salt such as tributyl benzyl ammonium-1-hydroxy-4-naphtosulfonate, and tetrabutyl ammonium tetrafluoroborate, etc., onium salt such as nigrosine pigments, fatty acid metal salt, guanidine compounds, imidazole compounds, and phosphonium salt, etc., or a lake color containing these, triphenylmethane dyes or a lake color containing these, fatty acid metal salt, and diorganotin borate, etc., such as dibutyl tin oxide, dioctyltine oxide, and dicyclohexyl tin oxide are used. As a lake agent for forming the lake color, for example, phosphotungstic acid, phosphomolybdic acid, phosphotungstic molybdic acid, tannin acid, lauric acid, gallic acid, ferricyanic compound, and ferrocyanic compound are available.

As the negative charge control agent, there are available, for example, boron complex compounds (such as boron-benzilic acid complex), metal-containing salicylic acid compounds, metal-containing monoazo compounds, metal-containing acetylacetone compound, aromatic hydroxycarboxyl or metal salt thereof, aromatic monocarboxylate or metal salt thereof, aromatic polycarboxylate or metal salt thereof, phenol compounds (for example, bisphenol), urea compounds, metal-containing naphthoic acid compounds, quaternary ammonium salt, calixarene, silicon compounds, styrene-acrylate copolymer, styrene-acrylate-sulfonate copolymer, and nonmetallic carboxylate compounds, etc. Among these, in view of the charging performance and tint, boron complex compounds, metal salicylate compounds, and calixarene, etc., are preferable.

As the charge control resin, there are available, for example, a copolymer of an ionic monomer (for example, N,N-diethyl-N-methyl-2-(methacryloyloxy) ethylammonium-p-toluenesulfonate, etc.) having an ionic functional group such as ammonium salt, and a monomer which can be copolymerized with the ionic monomer (for example, styrene monomer, (meth)acryl monomer, etc.) although it is not limited to this.

The total content of the charge control agent and the charge control resin is, for example, with respect to 100 parts by weight of the binder resin for forming the toner particles, preferably 0.1 to 10 parts by weight, more preferably 1 to 5 parts by weight although it is not limited to these.

The toner particles can be formed by blending the illustrated binder resin, colorant, and other components as appropriate, fusing, kneading, and then crushing. The toner particles can also be formed by blending the monomer components for generating the illustrated binder resin, the illustrated colorant, and other components as appropriate, and polymerizing the monomer components by means of suspension polymerization.

The particle sizes of the toner particles are not especially limited, however, their average particle size measured by a particle size distribution measuring device based on the Coulter principle (for example, an accurate particle size distribution measuring device "Multisizer" series made by Beckman Coulter, Inc.) is preferably 3 to 15 μm, and more preferably 5 to 10 μm.

The resin microparticles are an external additive attached to the surfaces of the toner particles.

As a resin material forming the resin microparticles, there are available, for example, polyester resins (for example, polyethylene terephthalate, polybutylene terephthalate, etc.), styrene resins (for example, polystyrene, etc.), (meth)acryl resins (for example, polymethylmethacrylate, etc.), styrene-acryl resins (for example, copolymer of styrene and (meth) acrylate monomer, etc.), olefin resins (for example, polyethylene, polypropylene, etc.), polyamide resins, epoxy resins, and resins of mixtures of these.

The resin material may have monomer units such as ethylene glycol dimethacrylate (EGDM) and divinylbenzene, and these monomer units may be cross-linked. The EGDM and divinylbenzene act as a cross-linking agent when the resin material is cross-linked.

A resin material for forming the resin microparticles is preferably the following mixed resins among the illustrated resin materials.

- Mixed resin (styrene-acryl resin) containing styrene and (meth)acrylate monomer (preferably, methylmethacrylate) as material monomers, in which the content of styrene is more than 0% by weight and not more than 80% by weight, or the content of (meth) acrylate monomer in the material monomers is not less than 20% by weight and less than 100% by weight.
- Mixed resin containing (meth)acrylate monomer (preferably, methymethacrylate) and EGDM as material monomers, in which the content of (meth) acrylate monomer is not less than 60% by weight and less than 100% by weight, or the content of EGDM is more than 0% by weight and not more than 40% by weight, and preferably, the EGDM portion has a cross-linked structure.

At the time of production by means of emulsion polymerization of resin microparticles, it is preferable that a surfactant is selectively used according to the charging polarity required in the resin microparticles. For example, when the toner is a positive charge toner, an anionic surfactant and/or a nonionic surfactant is preferably used, and an anionic surfactant is more preferably used.

As the anionic surfactant, there are available, for example, carboxylate, sulfonate, sulfate ester, and phosphate ester surfactants, and among these, a sulfate ester anionic surfactant such as sodium lauryl sulfate is preferable.

As the nonionic surfactant, there are available, for example, polyoxyalkylene ether, polyoxyalkylene ester, polyalcohol fatty acid ester, sucrose fatty acid ester, and alkylpolyglycoside surfactants, and among these, a polyoxyalkylene ester anionic surfactant such as polypxyethylene nonylphenol is preferable.

The usage of the surfactant is, for example, with respect to 100 parts by weight of the resin material for forming the resin microparticles, preferably 0.1 to 10 parts by weight and more preferably 0.2 to 5 parts by weight although it is not especially limited.

The resin microparticles are closer to the binder resin for forming toner particles in the triboelectric series than inorganic microparticles such as silica microparticles described later. In addition, for example, the inorganic microparticles are high in hardness and are easily buried in the surfaces of the toner particles, and on the other hand, the resin microparticles are low in hardness, so that burying of the resin microparticles in the toner particles can be more easily suppressed than inorganic microparticles, and even when the time of contact with the carrier lasts long, a spacer effect can be obtained on the surfaces of the toner particles. Therefore, the resin microparticles are effective for suppressing fluctuations in charging capacity of the toner and suppressing toner scattering, fogging, or lowering in development performance.

Furthermore, it is preferable that, when the resin microparticles are used for the positive charge toner, the resin particles are designed so that their negative charging property is strong at the beginning of stirring with the carrier, and the positive charging property is stronger as the time of contact with the carrier lasts long, and on the other hand, when the resin microparticles are used for the negative charge toner, their positive charging property is strong at the beginning of stirring with the carrier and the negative charging property is stronger as the time of contact with the carrier lasts long.

The toner of the two-component developer is different in time of contact with the carrier in that the one staying for a long period of time in the development unit and the one immediately after being supplied into the development unit, so that the charging capacity differs, and therefore, electrostatic interaction may occur between the toners. However, by attaching the resin microparticles having the charging performance to the surfaces of the toner particles, even when the toner is in contact with the carrier for a long period of time, the charge quantity of the toner can be prevented from fluctuating, and as a result, a remarkable effect of preventing toner scattering and fogging can be obtained.

In detail, for example, when the toner of the two-component developer is a positive charge toner, it is preferable that the charging polarity of the resin microparticles of the two-component developer is negative at the beginning of stirring and mixing of the mixture of the resin microparticles and the carrier by the TURBULA shaker mixer, and changes positive when the stirring and mixing is continued.

The resin microparticles can be prepared by, for example, blending monomer components for generating the mentioned resin material and the mentioned surfactant and other components as appropriate and polymerizing the monomer components by means of suspension polymerization. The resin microparticles can also be prepared by blending the mentioned resin material and the mentioned surfactant and other components as appropriate, fusing and kneading, and crushing these.

The particle size of the resin microparticles is not especially limited, however, their average particle size measured by a field emission scanning electron microscope (for example, product model "JSM-7401" made by JEOL, Ltd.) is preferably 0.01 to 1 μm, and more preferably 0.05 to 1 μm.

The blending quantity of the resin microparticles to the toner particles is not especially limited; however, for example, with respect to 100 parts by weight of the toner particles, it is preferably 0.01 to 10 parts by weight, more preferably 0.1 to 1 parts by weight.

Silica microparticles are an external additive attached to the surfaces of the toner particles.

As the silica microparticles, there is available, for example, fine-powdery silica used as a surface preparation agent of the toner although it is not especially limited.

When the toner is a positive charge type, it is preferable that the silica microparticles have a positive charging property. As preferable positive charging silica microparticles in this case, there are available, for example, silica microparticles having coating made of polysiloxane containing amino modified silane and cyclic silazane, etc.

The particle size of the silica microparticles is not especially limited, however, their average particle size measured by a field emission type scanning electron microscope (for example, the above-mentioned "JSM-7401", etc.) is preferably 5 to 50 μm, and more preferably 7 to 30 μm.

The blending quantity of the silica microparticles to the toner particles is, for example, with respect to 100 parts by weight of the toner particles, 0.1 to 10 parts by weight, and more preferably 0.5 to 2 parts by weight although it is not limited.

The toner is obtained by blending the toner particles, the resin microparticles, and the silica microparticles and evenly stirring and mixing these by a stirring mixer such as a Henschel mixer or Nauta mixer.

The carrier in the two-component developer of the present invention has magnetic particles and resin coat layers coated on the surfaces of the magnetic particles.

As the magnetic particles, for example, there are available particles made of a magnetic material such as ferrite (sintered ferrite), magnetite, lithium, manganese, and iron powder, and preferably ferrite particles.

It is preferable that the magnetic particles have a saturated magnetization valve of 35 to 70 emu/g, a volume resistivity of $10^8$ to $10^{12}$ Ω·cm, and a volume average particle size of 35 to 60 μm.

As the resin material for forming the resin coat layers, for example, there are available silicone resins, fluorine resins, (meth) acryl resins, styrene resins, silicone resins, epoxy resins, and polyimide resins although it is not limited, and these are used independently or two or more of these are mixed and used.

When the toner is a positive charge type, the resin material for forming the resin coat layers is preferably a mixed material of an epoxy resin, a polyimide resin, a silicone resin, and a fluorine resin, or the like among the mentioned resin materials.

On the other hand, when the toner is a negative charge type, among the mentioned binder resins, a silicone resin and a (meth)acryl resin are preferable.

As the method for forming the resin coat layers, a known method can be selected as appropriate.

The thickness of the resin coat layer is set as appropriate according to the material of the carrier body and charging performance required for the carrier, and is preferably 0.2 to 5 μm, and more preferably 0.5 to 2 μm although it is not especially limited.

EXAMPLE

Next, the present invention will be described based on Examples and Comparative Examples, however, the present invention is not limited by the following Examples.

<Preparation of Silica Microparticles>

Preparation Example 1

There blended 0.5 parts by weight of dimethylpolysiloxane (trade name: "KF96-50cs" made by Shin-Etsu Chemical Co., Ltd.) and 0.5 parts by weight of 3-aminopropyltrimethoxysilane (trade name: "KBM-903" made by Shin-Etsu Chemical Co., Ltd.), then toluene was added thereto for dissolution and dilution. To the obtained dilution, 1 part by weight of fumed silica (BET specific surface area: 90±15 $m^2/g$, tradename: "Aerosil (registered trademark) #90" by Nippon Aerosil Co., Ltd.) was added thereto and the solution was stirred for 30 minutes while being irradiated with ultrasonic waves, whereby a mixture was obtained. Then, the obtained mixture was heated in a high-temperature tank at 150° C., the toluene was distilled away by a rotary evaporator to extract a solid, and the solid was dried by a vacuum dryer (50° C.) until the reduced quantity reached zero. Next, the solid after drying was heated for 3 hours at 200° C. in a nitrogen current in an electrical furnace. The resultant fine particles were crushed by a jet mill and trapped by a bag filter, whereby silica microparticles (silica microparticles a) were obtained.

Preparation Example 2

In preparation for dilution, the blending quantity of dimethylpolysiloxane was set to 1.5 parts by weight, and the blending quantity of 3-aminopropyltrimethoxysilane was set to 1.5 parts by weight. In preparation for the mixture, instead of the "Aerosil (registered trademark) #90," 1 part by weight of "Aerosil (registered trademark) #200" (fumed silica, BET specific surface area: 200±25 $m^2/g$, made by Nippon Aerosil Co., Ltd.) was used. Other reaction conditions and treatment conditions were set similar to Preparation Example 1, whereby silica microparticles (silica microparticles b) were obtained.

Preparation Example 3

In preparation for the dilution, the blending quantity of dimethylpolysiloxane was set to 2.5 parts by weight, and the blending quantity of 3-aminopropyltrimethoxysilane was set to 2.5 parts by weight. In preparation for the mixture, instead of the "Aerosil (registered trademark) #90," 1 part by weight of "Aerosil (registered trademark) #300" (fumed silica, BET specific surface area: 300±30 $m^2/g$, made by Nippon Aerosil Co., Ltd.) was used. Other reaction conditions and treatment conditions were set similar to Preparation Example 1, whereby silica microparticles (silica microparticles c) were obtained.

Preparation Example 4

In preparation for the dilution, silica microparticles (silica microparticles d) were obtained in the same manner as in Preparation Example 1 except that 1 part by weight of amino-modified polysiloxane (trade name: "KF-859" made by Shin-Etsu Chemical Co., Ltd.) was used instead of 0.5 parts by weight of dimethylpolysiloxane and 0.5 parts by weight of 3-aminopropyltrimethoxysilane.

<Preparation of Resin Microparticles>

Preparation Example 5

There blended 200 parts by weight of deionized water and 3 parts by weight of sodium lauryl sulfate (anionic surfactant), and heated to 80° C. in a nitrogen gas atmosphere, then 1 part by weight of ammonium persulfate (polymerization initiator) was added thereto while stirring. Furthermore, into the reactor vessel, 40 parts by weight of methylmethacrylate and 60 parts by weight of styrene were delivered by drops for one hour and stirred for another one hour, whereby an emulsion was obtained. Then, the obtained emulsion was dried, whereby resin microparticles (styrene-methacryl resin microparticles: resin microparticles A) were obtained.

The average particle size of the resin microparticles A was 80 nm. The average particle size of the resin microparticles was measured by a method described later.

The charge quantity when the resin microparticles A were stirred and mixed by the TURBULA shaker mixer was measured by a method described later. The results of this measurement are shown in Table 1 below.

Preparation Example 6

Resin microparticles (methacryl resin microparticles: resin microparticles B) were obtained in the same manner as in Preparation Example 5 except that 100 parts by weight of methylmethacrylate was used instead of the monomer mixture of 40 parts by weight of methylmethacrylate and 60 parts by weight of styrene.

The average particle size of the resin microparticles B was 90 nm. The charge quantity when the resin microparticles B were stirred and mixed by the TURBULA shaker mixer is as shown in Table 1 below.

Preparation Example 7

Resin microparticles (cross-linked methacryl resin microparticles: resin microparticles C) were obtained in the same manner as in. Preparation Example 5 except that a monomer mixture of 90 parts by weight of methylmethacrylate and 10 parts by weight of ethylene glycol dimetacrylate was used instead of the monomer mixture of 40 parts by weight of methylmethacrylate and 60 parts by weight of styrene.

The average particle size of the resin microparticles C was 83 nm. In the resin microparticles C, a cross-linked structure was formed by the ethylene glycol dimetacrylate units in molecules. The charge quantity when the resin particles C were stirred and mixed by a TURBULA shaker mixer is as shown in Table 1.

Preparation Example 8

Instead of 3 parts by weight of sodium lauryl sulfate (anionic surfactant), 4 parts by weight of polyoxyethylene nonylphenol (nonionic surfactant) was used, and instead of 1 part by weight of ammonium persulfate (polymerization initiator), 1 part by weight of potassium persulfate (polymerization initiator) was used. Besides these, the reaction conditions and treatment conditions were set to the same as those in Preparation Example 5, whereby resin microparticles (styrene-methacryl resin microparticles: resin microparticles D) were obtained.

The average particle size of the resin microparticles D was 83 nm. The charge quantity when the resin microparticles D were stirred and mixed by a TURBULA shaker mixer is as shown in Table 1 below.

Preparation Example 9

Resin microparticles (styrene-fluorine modified acryl resin microparticles: resin microparticles E) were obtained in the same manner as in Preparation Example 5 except that a monomer mixture of 40 parts by weight of trifluoromethylacrylate and 60 parts by weight of styrene was used instead of the monomer mixture of 40 parts by weight of methylmethacrylate and 60 parts by weight of styrene.

The average particle size of the resin microparticles E was 81 nm. The charge quantity when the resin microparticles E were stirred and mixed by a TURBULA shaker mixer is as shown in Table 1 below.

Preparation Example 10

There blended 0.5 parts by weight of alkylbenzyl trimethylamine (cationic surfactant, trade name: "cation 300" made by Sanyo Chemical Industries, Ltd.) was used instead of 3 parts by weight of sodium lauryl sulfate (anionic surfactant), 0.5 parts by weight of 2,2'-azobis (2-methylpropion amidine)

dihydrochloride (polymerization initiator, trade name: "V-50" made by Wako Pure Chemical Industries, Ltd.) was used instead of 1 part by weight of ammonium persulfate (polymerization initiator), and the stirring time after the monomer mixture was dripped was changed from 1 hour to 4 hours. Other reaction conditions and treatment conditions were set to the same as those of Preparation Example 7, whereby resin microparticles (cross-linked methacryl resin microparticles: resin microparticles F) were obtained.

The average particle size of the resin microparticles F was 80 nm. In the resin microparticles F, a cross-linked structure was formed by the ethylene glycol dimethacrylate units in molecules. The charge quantity when the resin particles E were stirred and mixed by a TURBULA shaker mixer is as shown in Table 1 below.

<Measurement of Charge Quantity of Resin Microparticles>

Using the resin microparticles A through F obtained in Preparation Examples 5 to 10, the charging quantities Q/M (μC/g, Q: charge quantity of resin microparticles, M: mass of resin microparticles) when the mixtures of the resin microparticles and the carrier were stirred and mixed by a TURBULA shaker mixer were measured.

In detail, 0.22 g of resin microparticles and 300 g of the carrier A obtained in Preparation Example 13 described below were mixed, the obtained mixture was put into a TURBULA shaker mixer (tumbler mixer, produce model "T2F" made by Shinmaru Enterprises Corporation) and stirred and mixed. Then, for each of the resin microparticles A through F, 4 samples stirred for 1 minute, 5 minutes, 30 minutes, and 120 minutes were prepared and the charge quantities Q/M (μC/g) of the resin microparticles in the respective samples were measured by a suction charge quantity measuring device (q/m meter, product model "MODEL210HS" made by Trek Japan KK). The results of this measurement are shown in Table 1.

<Measurement of Average Particle Size of Resin Microparticles>

As average particles sizes of the resin microparticles A through F obtained in Preparation Examples 5 to 10, individual particle sizes were measured from images of 30 resin microparticles imaged with the field emission type scanning electron microscope (type "JSM-7401" made by JEOL, Ltd.) and arithmetic averages thereof were calculated. The results of this measurement are shown in Table 1.

In Table 1, the column "Monomer" indicates the composition of the monomer mixture for forming the resin microparticles, "St" indicates styrene, "MMA" indicates methylmethacrylate, "EGDM" indicates ethylene glycol dimetacrylate, and "FMAc" indicates trifluoromethylacrylate. The column "Cross-linked structure" indicates the existence of a cross-linked structure in the resin microparticles, and "formed" means a cross-linked structure is formed by the EGDM contained in the monomer mixture. The column "Surfactant" indicates the kind of surfactant blended when the resin microparticles are formed, and "anionic", "nonionic," and "cationic" indicate an anionic surfactant, a nonionic surfactant, and a cationic surfactant, respectively.

As shown in Table 1, in the case of the resin microparticles A through D, the charging polarity when the resin microparticles were stirred together with the carrier A by the TURBULA shaker mixer was negative when the stirring time was 1 minute and 5 minutes, whereas when the stirring time was 30 minutes and 120 minutes, it turned into positive.

On the other hand, in the case of the resin microparticles E made of a fluorine-modified styrene-acryl resin, the charging polarity when the resin microparticles E were stirred together with the carrier A by the TURBULA shaker mixer was negative regardless of the stirring time, and the absolute value of the charge quantity Q/M (μC/g) was remarkably larger than that of other resin microparticles.

In the case of the resin microparticles F blended with a cationic surfactant as a surfactant, the charging polarity when the resin microparticles were stirred together with the carrier A by the TURBULA shaker mixer was positive until the stirring time reached 120 minutes.

<Preparation of Toner Particles>

Preparation Example 11

There put 100 parts by weight of a styrene-acryl resin, 4 parts by weight of a mold release agent, 12 parts by weight of carbon black (colorant), and 1 part by weight of a charge control agent into a Henschel mixer and mixed, and then fused and kneaded by a biaxial extruding machine, and the obtained fused and kneaded material was cooled by a drum flaker. Next, the fused and kneaded material which was cooled and crushed into flake shapes was roughly crushed by

TABLE 1

| | Resin microparticles | | | | | |
|---|---|---|---|---|---|---|
| | A | B | C | D | E | F |
| Monomer (weight ratio) | St/MMA (60/40) | MMA (100) | MMA/EGDM (90/10) | St/MMA (60/40) | St/FMAc (60/40) | MMA/EGDM (90/10) |
| Cross-linked structure | Not structured | Not structured | Structured | Not structured | Not structured | Structured |
| Surfactant | Anionic | Anionic | Anionic | Nonionic | Anionic | Cationic |
| Average particle size | 80 nm | 90 nm | 83 nm | 83 nm | 81 mm | 80 nm |
| Charge quantity Q/M (μC/g) | | | | | | |
| 1 minute | −13.85 | −38.85 | −12.98 | −21.61 | −99.55 | 37.31 |
| 5 minute | −4.86 | −35.66 | −9.56 | −10.83 | −95.45 | 17.39 |
| 30 minute | 35.56 | 12.27 | 8.41 | 38.87 | −99.00 | 15.38 |
| 120 minute | 43.14 | 25.06 | 35.13 | 46.77 | −97.27 | 5.95 |

a hammer mill, then finely crushed by a turbo mill, and classified using an air classifier, whereby toner particles (toner particles A) were obtained.

The volume average particle size of the toner particles A was 9.09 μμm, and the average circularity thereof was 0.929. The volume average particle size and the average circularity of the toner particles were measured by the method described later.

Preparation Example 12

Toner particles (toner particles B) were obtained in the same manner as in Preparation Example 11 except that the driving conditions of the turbo mill used for fine crushing were changed.

The volume average particle size of the toner particles B was 6.24 μm, and the average circularity thereof was 0.939.

<Measurement of Volume Average Particle Size and Average Circularity of Toner Particles>

The volume average particle sizes of the toner particles A and B obtained in Preparation Examples 11 and 12 were measured using a particle size distribution measuring device (accurate particle size distribution measuring device "Multisizer II" made by Beckman Coulter, Inc.).

The average circularities of the toner particles A and B obtained in Preparation Examples 11 and 12 were calculated based on results of image analysis for each of the toner particles, and in detail, by means of image analysis, the circularity was calculated by calculating a circle having the same area as that of a projection plane of one toner particle and dividing the peripheral length of the circle by the peripheral length of the projection plane. As the circularity is closer to 1, the toner particle is closer to a sphere.

In detail, as the average circularity of the toner particle, the circularities of toner particle samples (total number: 500 to 3000) whose particle sizes were within the range of 0.6 to 400 μm were measured by a flow-type particle image analyzer (type "FPIA-2000" made by Sysmex Corporation) and an arithmetic average thereof was calculated.

<Preparation of Carrier>

Preparation Example 13

There put 10 kg of a commercially available carrier (ferrite carrier, trade name: "F51-50" with a particle size of about 50 μm made by Powdertech Co., Ltd.) into a fluid bed coating apparatus (Spiral Flow, type "SFC-5" made by Freund Corporation).

Next, 2 kg of an epoxy resin (bisphenol A type, trade name: "EPIKOTE (registered trademark) 1004" made by Japan Epoxy Resins Co., Ltd.) was dissolved in 20 liters of acetone and further blended with 100 g of diethylene triamine and 150 g of phthalic anhydride, stirred, and mixed to prepare a mixture, and the obtained mixture was put into the fluid bed coating apparatus. After the mixture was put into the apparatus, the epoxy resin was coated on the surface of the carrier while blowing hot air at 80° C. into the fluid bed coating apparatus, and heated for 1 hour at 180° C. in a drier, whereby a carrier was obtained.

<Production of Two-Component Developer>

Example 1

To 100 parts by weight of the toner particles A obtained in Preparation Example 11, 1 part by weight of the silica microparticles a obtained in Preparation Example 1 and 1 part by weight of the resin microparticles A (styrene-acryl resin microparticles) obtained in Preparation Example 5 were blended and stirred and mixed (at a rotation speed of 30 m/s for 3 minutes) by a Henschel mixer, whereby a toner was obtained.

Then, the obtained toner and the carrier obtained in Preparation Example 13 were evenly stirred and mixed by a Nauta mixer so that the blending quantity T of the toner was set 10% by weight of the blending quantity C of the carrier (T/C was 10%), whereby a two-component developer (developer A) was obtained.

Example 2

A toner was obtained in the same manner as in Example 1 except that 1 part by weight of the resin microparticles B (acryl resin microparticles) obtained in Preparation Example 6. Then, the obtained toner and the carrier obtained in Preparation Example 13 were blended so that T/C was set 10%, and evenly stirred and mixed by a Nauta mixer, whereby a two-component developer (developer B) was obtained.

Example 3

A toner was obtained in the same manner as in Example 1 except that 1 part by weight of the resin microparticles C (styrene-acryl resin microparticles) obtained in Preparation Example 7 was blended instead of 1 part by weight of the resin microparticles A. Then, the obtained toner and the carrier obtained in Preparation Example 13 were blended so that T/C was set 10%, and evenly stirred and mixed by a Nauta mixer, whereby a two-component developer (developer C) was obtained.

Example 4

A toner was obtained in the same manner as in Example 1 except that 1 part by weight of the resin microparticles D (styrene-acryl resin microparticles) obtained in Preparation Example 8 was blended instead of 1 part by weight of the resin microparticles A. Then, the obtained toner and the carrier obtained in Preparation Example 13 were blended so that T/C was set 10%, and evenly stirred and mixed by a Nauta mixer, whereby a two-component developer (developer D) was obtained.

Example 5

A toner was obtained in the same manner as in Example 1 except that 0.6 parts by weight of the silica microparticles b was obtained in Preparation Example 2 instead of 1 part by weight of the silica microparticles a. Then, the obtained toner and the carrier obtained in Preparation Example 13 were blended so that T/C was set 10%, and evenly stirred and mixed by a Nauta mixer, whereby a two-component developer (developer E) was obtained.

Example 6

A toner was obtained in the same manner as in Example 1 except that 0.45 parts by weight of the silica microparticles c obtained in Preparation Example 3 was blended instead of 1 part by weight of the silica microparticles a. Then, the obtained toner and the carrier obtained in Preparation Example 13 were blended so that T/C was set 10%, and evenly stirred and mixed by a Nauta mixer, whereby a two-component developer (developer F) was obtained.

Example 7

To 100 parts by weight of the toner particles B obtained in Preparation Example 12, 1 part by weight of the silica microparticles a obtained in Preparation Example 1 and 1 part by weight of the resin microparticles A (styrene-acryl resin microparticles) obtained in Preparation Example 5 were blended and stirred and mixed by a Henschel mixer (at a rotation speed of 30 m/s for 3 minutes), whereby a toner was obtained.

Then, the obtained toner and the carrier obtained in Preparation Example 13 were blended so that T/C was set 15%, and evenly stirred and mixed by a Nauta mixer, whereby a two-component developer (developer G) was obtained.

Example 8

To 100 parts by weight of the toner particles A obtained in Preparation Example 11, 1 part by weight of the silica microparticles a obtained in Preparation Example 1 and 1 part by weight of the resin microparticles A (styrene-acryl resin microparticles) obtained in Preparation Example 5 were blended and stirred and mixed by a Henschel mixer (at a rotation speed of 40 m/s for 5 minutes), whereby a toner was obtained.

Then, the obtained toner and the carrier obtained in Preparation Example 13 were blended so that T/C was set 10%, and evenly stirred and mixed by a Nauta mixer, whereby a two-component developer (developer H) was obtained.

Example 9

A toner was obtained in the same manner as in Example 1 except that the blending quantity of the silica microparticles a was set to 1.5 parts by weight and the blending quantity of the resin microparticles A was set to 0.5 parts by weight. Then, the obtained toner and the carrier obtained in Preparation Example 13 were blended so that T/C was set 10%, and evenly stirred and mixed by a Nauta mixer, whereby a two-component developer (developer I) was obtained.

Comparative Example 1

A toner was obtained in the same manner as in Example 1 except that 1 part by weight of the resin microparticles E was blended instead of 1 part by weight of the resin microparticles A. Then, the obtained toner and the carrier obtained in Preparation Example 13 were blended so that T/C was set 10%, and evenly stirred and mixed by a Nauta mixer, whereby a two-component developer (developer J) was obtained.

Comparative Example 2

A toner was obtained in the same manner as in Example 1 except that 1 part by weight of the resin microparticles F was blended instead of 1 part by weight of the resin microparticles A. Then, the obtained toner and the carrier obtained in Preparation Example 13 were blended so that T/C was set 10%, and evenly stirred and mixed by a Nauta mixer, whereby a two-component developer (developer K) was obtained.

Comparative Example 3

A toner was obtained in the same manner as in Example 1 except that 0.9 parts by weight of the silica microparticles b was blended instead of 1 part by weight of the silica microparticles a and the blending quantity of the resin microparticles A was set to 0.5 parts by weight. Then, the obtained toner and the carrier obtained in Preparation Example 13 were blended so that T/C was set 10%, and evenly stirred and mixed by a Nauta mixer, whereby a two-component developer (developer L) was obtained.

Comparative Example 4

A toner was obtained in the same manner as in Example 1 except that 2 parts by weight of the silica microparticles a was blended instead of 1 part by weight of the silica microparticles a and no resin microparticles were blended. Then, the obtained toner and the carrier obtained in Preparation Example 13 were blended so that T/C was set 10%, and evenly stirred and mixed by a Nauta mixer, whereby a two-component developer (developer M) was obtained.

Comparative Example 5

A toner was obtained in the same manner as in Example 1 except that 1.2 parts by weight of the silica microparticles b was blended instead of 1 part by weight of the silica microparticles a and no resin microparticles were blended. Then, the obtained toner and the carrier obtained in Preparation Example 13 were blended so that T/C was set 10%, and evenly stirred and mixed by a Nauta mixer, whereby a two-component developer (developer N) was obtained.

Comparative Example 6

A toner was obtained in the same manner as in Example 1 except that 1.5 parts by weight of the resin microparticles A was blended instead of 1 part by weight of the resin microparticles A and no silica microparticles were blended. Then, the obtained toner and the carrier obtained in Preparation Example 13 were blended so that T/C was set 10%, and evenly stirred and mixed by a Nauta mixer, whereby a two-component developer (developer O) was obtained.

Comparative Example 7

A toner was obtained in the same manner as in Example 1 except that 1 part by weight of the silica microparticles d was blended instead of 1 part by weight of the silica microparticles a. Then, the obtained toner and the carrier obtained in Preparation Example 13 were blended so that T/C was set 10%, and evenly stirred and mixed by a Nauta mixer, whereby a two-component developer (developer P) was obtained.

The toner ratios, the kinds and average particle sizes of the toner particles, the kinds and blending quantities of silica microparticles, and the kinds and blending quantities of the resin particles of the two-component developers A through O obtained in Examples 1 to 9 and Comparative Examples 1 to 7 are shown in Table 2.

TABLE 2

| | Two-component developer (T/C) | Toner particles (average particle size) | Silica microparticles (blending quantity) | Resin microparticles (blending quantity) |
|---|---|---|---|---|
| Example 1 | A (10%) | A (9.09 μM) | a (1 part by weight) | A (1 part by weight) |
| Example 2 | B (10%) | A (9.09 μM) | a (1 part by weight) | B (1 part by weight) |
| Example 3 | C (10%) | A (9.09 μM) | a (1 part by weight) | C (1 part by weight) |
| Example 4 | D (10%) | A (9.09 μM) | a (1 part by weight) | D (1 part by weight) |
| Example 5 | E (10%) | A (9.09 μM) | b (0.6 parts by weight) | A (1 part by weight) |
| Example 6 | F (10%) | A (9.09 μM) | c (0.45 parts by weight) | A (1 part by weight) |
| Example 7 | G (15%) | B (6.24 μM) | a (1 part by weight) | A (1 part by weight) |
| Example 8 | H (10%) | A (9.09 μM) | a (1 part by weight) | A (1 part by weight) |
| Example 9 | I (10%) | A (9.09 μM) | a (1.5 parts by weight) | A (0.5 parts by weight) |
| Comparative Example 1 | J (10%) | A (9.09 μM) | a (1 part by weight) | E (1 part by weight) |
| Comparative Example 2 | K (10%) | A (9.09 μM) | a (1 part by weight) | F (1 part by weight) |
| Comparative Example 3 | L (10%) | A (9.09 μM) | b (0.9 parts by weight) | A (0.5 parts by weight) |
| Comparative Example 4 | M (10%) | A (9.09 μM) | a (2 parts by weight) | — |
| Comparative Example 5 | N (10%) | A (9.09 μM) | b (1.2 parts by weight) | — |
| Comparative Example 6 | O (10%) | A (9.09 μM) | — | A (1.5 parts by weight) |
| Comparative Example 7 | P (10%) | A (9.09 μM) | d (1 part by weight) | A (1 part by weight) |

In Table 2, the symbols A through O in the column "Two-component developer" correspond to the symbols of the developers obtained in the Examples and the Comparative Examples, and in the same column, weight ratios with respect to the carrier blending quantity are shown in parentheses (T/C). The symbols A and B in the column "Toner particles" correspond to the symbols of toner particles obtained in Preparation Examples 11 and 12. The symbols a through d in the column "Silica microparticles" correspond to the symbols of the silica microparticles obtained in Preparation Examples 1 to 4, and in the same column, blending quantities (parts by weight) of the silica microparticles with respect to 100 parts by weight of the toner particles are shown in parentheses (blending quantity). The symbols A through F in the column "Resin microparticles" correspond to the symbols of the resin microparticles obtained in Preparation Examples 5 to 11, and in the parentheses (blending quantity) of the same column, the blending quantity (part by weight) of resin microparticles with respect to 100 parts by weight of toner particles is shown.

In Table 1, the developer A of Example 1 and the developer H of Example 8 are different from each other in stirring conditions (rotation speed and stirring time) with use of a Henschel mixer at the time of toner preparation.

<Property Evaluation of Two-Component Developers>

(1) Measurement of BET Specific Surface Area of Toner

Using the two-component developers A through P obtained in Examples 1 to 9 and Comparative Examples 1 to 7, the BET specific surface area A ($m^2/g$) of the toner was measured when the stirring and mixing were performed by a TURBULA shaker mixer.

In detail, 30 g of the two-component developer was put into a TURBULA shaker mixer (type "T2F" made by Shinmaru Enterprises Corporation) and stirred, and then two samples which were stirred for 1 minute and 120 minutes were prepared for each of the two-component developers A through P.

Then, the BET specific surface area A ($m^2/g$) of the toner in each sample was measured by a BET specific surface area measuring device (type "HM Model-1208" made by Mountech Co., Ltd.). The measuring conditions were a degassing temperature of 45° C., a degassing time of 45 minutes, and a nitrogen flow rate of 25 mL/min. The results of this measurement are shown in Table 3 below.

(2) Measurement of Charge Quantity of Carrier

Using the two-component developers A through P obtained in Examples 1 to 9 and Comparative Examples 1 to 7, the charge quantity of the carrier was measured when the stirring and mixing were performed by a TURBULA shaker mixer.

In detail, two samples in which each was stirred for 1 minute and 120 minutes were prepared for each of the two-component developers A through P, and the charge quantity Q/M (μC/g, Q: charge quantity of carrier, M: weight of carrier) of the carrier in each sample was measured in 635 meshes (20 μm spaced) using a suction charge quantity measuring device (q/m meter of the type "MODEL210HS" made by Trek Japan KK). The results of this measurement are as shown in Table 3 below.

(3) Evaluation of Image Quality

Using the two-component developers A through P obtained in Examples 1 to 9 and Comparative Examples 1 to 7, image forming processing was performed and image quality was evaluated.

Image forming processing was tested by continuously printing 200,000 sheets of document whose printing density (ISO) was 5% and by intermittently printing 50,000 sheets of document whose printing density (ISO) was 2% using a color printer (trade name: "FS-C5016N" made by KYOCERA MITA Corp.).

i) Image Density

An image obtained by the image forming processing was measured by a spectral photometer (trade name: "Spectro-Eye" made by GretagMacbeth AG) . An image density ID was determined as good when it was 1.2 or more,and defective when it was less than 1.2 in the case of continuous printing of 200,000 sheets at ISO 5% and in the case of intermittent printing of 50,000 sheets at ISO 2%.

ii) Image Fogging Density

Measurement was made using the same spectral photometer as that of i). The fogging density FD was determined as good when it was 0.008 or less and defective when it was less than 0.008 in the case of continuous printing of 200,000 sheets at ISO 5% and in the case of intermittent printing of 50,000 sheets at ISO 2%.

iii) Toner Scattering

After the intermittent printing of 50,000 sheets at ISO 2%, toner that scattered to the jaw of the development unit was suctioned and measured. Toner scattering was evaluated as good when no scattering was detected (in Table 4, shown as "none") and as defective when it exceeded 0.5 g (in Table 4, shown as "scattered").

The results of this evaluation are shown in Table 4.

TABLE 3

| | BET specific surface area of toner | | | Charge quantity Q/M of carrier | | |
|---|---|---|---|---|---|---|
| | $A_1$ | $A_{120}$ | ΔA (%) | $C_1$ | $C_{120}$ | ΔC (%) |
| Example 1 (A) | 2.623 | 2.481 | −5.4 | −1.76 | −1.67 | −5.2 |
| Example 2 (B) | 2.617 | 2.484 | −5.1 | −1.79 | −1.69 | −5.5 |
| Example 3 (c) | 2.633 | 2.493 | −5.3 | −1.72 | −1.61 | −6.5 |
| Example 4 (D) | 2.597 | 2.449 | −5.7 | −1.65 | −1.55 | −6.3 |
| Example 5 (E) | 2.778 | 2.534 | −8.8 | −1.52 | −1.41 | −7.5 |
| Example 6 (F) | 2.941 | 2.650 | −9.9 | −1.57 | −1.43 | −8.7 |
| Example 7 (G) | 3.116 | 2.863 | −8.1 | −1.56 | −1.52 | −2.4 |
| Example 8 (H) | 2.489 | 2.328 | −6.5 | −1.61 | −1.52 | −5.7 |
| Example 9 (I) | 2.353 | 2.125 | −9.7 | −1.86 | −1.68 | −9.6 |
| Comparative Example 1 (J) | 2.588 | 2.472 | −4.5 | −1.07 | −0.88 | −17.7 |
| Comparative Example 2 (K) | 2.622 | 2.486 | −5.2 | −2.14 | −1.45 | −32.2 |
| Comparative Example 3 (L) | 2.585 | 2.241 | −13.3 | −1.61 | −1.43 | −11.3 |
| Comparative Example 4 (M) | 2.085 | 1.663 | −20.2 | −1.94 | −1.67 | −13.8 |
| Comparative Example 5 (N) | 2.391 | 1.607 | −32.8 | −1.79 | −1.27 | −28.9 |
| Comparative Example 6 (O) | 2.646 | 2.572 | −2.8 | −1.41 | −1.75 | −24.2 |
| Comparative Example 7 (P) | 2.620 | 2.416 | −7.8 | −1.63 | −1.18 | −27.7 |

TABLE 4

| | Image density ID | | Fogging density FD | | |
|---|---|---|---|---|---|
| | ISO2% 200,000 sheets Continuous | ISO2% 50,000 sheets Intermittent | ISO2% 200,000 sheets Continuous | ISO2% 50,000 sheets Intermittent | Toner scattering |
| Example 1 (A) | 1.41 | 1.39 | 0.002 | 0.002 | Not scattered |
| Example 2 (B) | 1.39 | 1.38 | 0.002 | 0.003 | Not scattered |
| Example 3 (c) | 1.38 | 1.40 | 0.001 | 0.002 | Not scattered |
| Example 4 (D) | 1.42 | 1.40 | 0.002 | 0.001 | Not scattered |
| Example 5 (E) | 1.39 | 1.36 | 0.001 | 0.003 | Not scattered |
| Example 6 (F) | 1.40 | 1.35 | 0.002 | 0.003 | Not scattered |
| Example 7 (G) | 1.32 | 1.30 | 0.000 | 0.001 | Not scattered |
| Example 8 (H) | 1.37 | 1.37 | 0.003 | 0.002 | Not scattered |
| Example 9 (I) | 1.33 | 1.31 | 0.003 | 0.004 | Not scattered |
| Comparative Example 1 (J) | 1.69 | 1.68 | 0.008 | 0.010 | Slightly scattered |
| Comparative Example 2 (K) | 1.22 | 1.42 | 0.001 | 0.009 | Scattered |
| Comparative Example 3 (L) | 1.31 | 1.29 | 0.003 | 0.006 | Slightly scattered |
| Comparative Example 4 (M) | 1.30 | 1.24 | 0.002 | 0.004 | Scattered |
| Comparative Example 5 (N) | 1.26 | 1.15 | 0.003 | 0.011 | Scattered |
| Comparative Example 6 (O) | 0.87 | 0.58 | 0.001 | 0.002 | Not scattered |
| Comparative Example 7 (P) | 1.45 | 1.37 | 0.003 | 0.007 | Slightly scattered |

As shown in Table 3 and Table 4, the results show that the two-component developers of Examples 1 to 9 whose rates of change ΔA in BET specific surface area of the toner and rates of change ΔC in charging rate of the carrier when the mixture of the toner and carrier was stirred and mixed by a TURBULA shaker mixer satisfied the ranges shown in the expressions (i) and (ii) suppressed burying of the external additive into the toner particles and a change in charging performance of the toner with time, and secured stable development performance even when the image forming processing was repeated.

In addition, it was found that the two-component developers of Examples 1 to 9 were preferable in image forming processing of an image forming apparatus based on a hybrid development method.

The present invention is not limited to the description given above, and can be variously changed in design within the scope of the matters described in the claims.

The present invention was provided as illustrative embodiments of the invention; however, these are only examples and should not be construed as limiting the invention. Modifications of the present invention obvious to people skilled in the art of the present invention are included in the claims described later.

The disclosure of Japanese patent application No. 2006-049583, filed on Feb. 27, 2006 is incorporated herein by reference.

What is claimed is:

1. A two-component developer comprising:

a toner containing toner particles which contain a binder resin and a colorant, resin microparticles adhering to surfaces of the toner particles, and silica microparticles adhering to the surfaces of the toner particles; and a carrier containing magnetic particles and resin coat layers coated on surfaces of the magnetic particles, wherein a rate of change ΔA (%) in BET specific surface area A ($m^2/g$) of the toner expressed by the expression (i) $\Delta A=((A_{120}-A_1)/A_1)\times 100$, and a rate of change ΔC (%) in charge quantity C (μC/g) of the carrier expressed by the expression (ii) $\Delta C=((C_{120}-C_1)/C_1)\times 100$, when a mixture of the toner and the carrier is stirred and mixed by a TURBULA shaker mixer are both within 10%, and wherein, in the above-described expressions (i) and (ii), $A_1$ indicates a BET specific surface area ($m^2/g$) of the toner when the mixture of the toner and the carrier is stirred and mixed for 1 minute by a TURBULA shaker mixer, $A_{120}$ indicates a BET specific surface area ($m^2/g$) of the toner when the mixture of the toner and the carrier is stirred and mixed for 120 minutes by a TURBULA shaker mixer, $C_1$ indicates a charge quantity (μC/g) of the carrier when the mixture of the toner and the carrier is stirred and mixed for 1 minute by a TURBULA shaker mixer, and $C_{120}$ indicates a charge quantity (μC/g) of the carrier when the mixture of the toner and the carrier is stirred and mixed for 120 minutes by a TURBULA shaker mixer.

2. The two-component developer according to claim 1, wherein the toner is a positive charge toner, and a charging polarity of the resin microparticles is negative at the beginning of stirring and mixing of the mixture of the resin microparticles and the carrier by the TURBULA shaker mixer to change positive when the stirring and mixing is continued.

3. The two-component developer according to claim 1, wherein a resin material for forming the resin microparticles is:

(i) a mixed resin containing styrene and (meth)acrylate monomer as material monomers, in which the content of styrene is more than 0% by weight and not more than 80% by weight, or the content of (meth)acrylate monomer in the material monomers is not less than 20% by weight and less than 100% by weight, or (ii) a mixed resin containing (meth)acrylate monomer and ethylene glycol dimethacrylate (EGDM) as material monomers, in which the content of (meth)acrylate monomer is not less than 60% by weight and less than 100% by weight, or the content of EGDM is more than 0% by weight and not more than 40% by weight.

4. The two-component developer according to claim 1, wherein the developer is for a developing method in which the developer comprising a toner and a carrier is held on the peripheral surface of a magnetic roller, then the developer is brought into contact with the peripheral surface of a development roller disposed to face the magnetic roller to form a layer consisting of only the toner on the development roller, and the obtained toner layer is flown onto an electrostatic latent image carrier disposed to face the development roller and an electrostatic latent image formed in advance on the electrostatic latent image carrier is developed as a toner image.

5. The two-component developer according to claim 1, wherein the developer is for an image forming apparatus using an amorphous silicon photoreceptor.

* * * * *